US005117212A

United States Patent [19]

Yamamoto et al.

[11] Patent Number: 5,117,212

[45] Date of Patent: May 26, 1992

[54] ELECTROMAGNET FOR CHARGED-PARTICLE APPARATUS

[75] Inventors: Shunji Yamamoto; Tadatoshi Yamada, both of Amagasaki, Japan

[73] Assignee: Mitsubishi Denki K.K., Tokyo, Japan

[21] Appl. No.: 463,585

[22] Filed: Jan. 11, 1990

[30] Foreign Application Priority Data

Jan. 12, 1989 [JP] Japan ..... 1-3693
Jan. 13, 1989 [JP] Japan ..... 1-4768
Oct. 6, 1989 [JP] Japan ..... 1-260083

[51] Int. Cl.[5] ..... H01F 7/00

[52] U.S. Cl. ..... 335/210; 335/299; 335/297

[58] Field of Search ..... 335/210, 216, 299, 297, 335/298

[56] References Cited

U.S. PATENT DOCUMENTS 3,681,599 8/1972 Takumi ..... 335/210
4,737,727 4/1988 Yamada ..... 335/216
4,769,623 9/1988 Marshing ..... 335/299
4,887,059 12/1989 Asano ..... 335/297
4,902,993 2/1990 Krevet ..... 335/299

FOREIGN PATENT DOCUMENTS 266800 5/1988 Japan .

*Primary Examiner*—Leo P. Picard
*Assistant Examiner*—Trinidad Korka
*Attorney, Agent, or Firm*—Sughrue, Mion, Zinn, Macpeak & Seas

[57] ABSTRACT

An electromagnet for a charged-particle apparatus. The electromagnet of the first form of this invention may consist of a deflecting electromagnet comprising an iron core equipped with clamping plates having cavities through which a vacuum chamber runs. Provided in these cavities are small-sized coils using the iron core as the magnetic path and adapted to adjust the orbit for charged particles. The electromagnet of the second form of this invention consists of a deflecting electromagnet equipped with a banana-shaped principal coil whose radius of curvature is larger in its end sections than in its middle section, thereby leveling the magnetic-field distribution on the equilibrium orbit. In the electromagnet of the third form of this invention, the thickness of the iron core, surrounding the principal coil, is different at different positions along the equilibrium orbit for charged particles, thereby making it possible to obtain some desired magnetic-field distribution. The first and third forms of the electromagnet, in particular, are not restricted to a deflecting electromagnet in a charged-particle apparatus but is applicable to other types of electromagnets in a charged-particle apparatus.

19 Claims, 16 Drawing Sheets

ELECTROMAGNET FOR CHARGED-PARTICLE APPARATUS

BACKGROUND OF THE INVENTION

1. Field of the Invention

This invention relates to an electromagnet for a charged-particle apparatus, and in particular, to the construction of a deflecting electromagnet.

2. Description of the Related Art

FIG. 1 is a plan view showing, by way of example, the charged-particle apparatus which was disclosed in "Superconducting Racetrack Electron Storage Ring and Coexistent Injector Microtron for Synchrotron Radiation" by Yoshikazu Miyahara, Koji Takata, and Tetsyta Nakanishi in the September 1984 issue of Technical Report No. 21 of the ISSP published by the Japan Chemical Engineering Information Center.

In the apparatus shown, charged particles are accumulated in an accumulation ring 1 constituting the charged-particle apparatus. These charged particles (e.g., electrons) are introduced into the accumulation ring 1 along an incident beam line 2. This apparatus is equipped with deflecting electromagnets 3 which are superconducting electgromagnets adapted to form an equilibrium orbit 4 by deflecting the charged particles and which are formed by combining deflecting coils as described below.

Radiation beam lines 5 are used for extracting radiations which are generated when the charged particles are deflected in the deflecting electromagnets 3. This radiation, which is called synchrotron radiation or SOR (synchrotron orbital radiation), is extracted and utilized for lithography, etc. Generally, a large number of radiation beam lines 5 are provided along the deflecting electromagnets 3 with a view to enhancing the efficiency of the apparatus. In the drawing, however, each deflecting electromagnet 3 is shown as provided with only one radiation beam line.

Four-pole electromagnets 6 are used to focus the charged particles in the accumulation ring 1, and six-pole electromagnets 7 are used to correct any non-linear magnetic fields or chromaticity of the deflecting electgromagnets 3. A high-frequency cavity 8 serves to compensate for the energy loss of the charged particles due to the emission of the ratiation, thereby accelerating them back to a predetermined energy level. A kicker magnet 9 shifts the equilibrium orbit 4 when introducing charged particles along the incident beam line 2, thereby aiding the introduction of new charged particles. A vacuum chamber 10 serves as a passage for the charged particles, an inflector 11 helps the charged particles to enter the accumulation ring 1 along the incident beam line 2, and a vacuum pump 12 serves to maintain a good vacuum in the vacuum chamber 10. These components are arranged along the equilibrium orbit 4. The vacuum chamber 10 has a high level of mechanical strength and is made of a stainless steel which may be readily baked to remove gases. An ultra-high vacuum is maintained on the inside of this vacuum chamber 10 by the vacuum pump 12, which prevents the charged particles from colliding with the gas molecules and losing energy, which would shorten their lives.

Next, FIGS. 2 to 4 are a perspective view, a plan view and a side view, respectively, showing one of the deflecting electromagnets 3 of FIG. 1.

The deflecting electromagnet 3 shown is composed of a pair of superconducting coils: an upper and a lower coil 31 and 32. Since these coils exert an ultra-high magnetic force, they adopt an air-iron core structure without iron cores. Arrows $m_1$ and $m_2$ indicate the direction of the electric currents in the coils 31 and 32, and arrow n indicates the direction of the electron beam on the equilibrium orbit 4. As is apparent from FIGS. 3 and 4, the equilibrium orbit 4 can be represented on a plane of a polar coordinate $R\theta$ ($z=0$) by a semicircle $\rho_0$ and straight lines connected thereto. $\rho_1$ and $\rho_2$ indicate the inner and outer radii, respectively, of the banana-shaped coils 31 and 32.

Next, the operation of the conventional charged-particle apparatus shown in FIGS. 1 to 4 will be described.

The charged particles, introduced into the accumulation ring 1 along the incident beam line 2, are deflected in a pulse-like manner by the inflector 11, and their orbit is shifted by the kicker magnet 9. Thus, the charged particles circulate first along an orbit which deviates somewhat from the equilibrium orbit 4. After making several circuits, they come to circulate along the equilibrium orbit 4 in the direction indicated by arrow n. This equilibrium orbit 4 is determined by the manner of arrangement of the deflecting electromagnets 3 and of the four-pole electromagnets 6. The principal magnetic field generated in the upper and lower coils 31 and 32 by the electric currents in the direction $m_1$ and $m_2$ is in the $-z$ ($-y$) direction, and the electric current flowing along the equilibrium orbit 4 is in the direction reverse to the electron-beam direction n. Accordingly, the charged particles, i.e., the electron beams, passing between the upper and lower coils 31 and 32 (in FIG. 2) receives an electromagnetic force in the $-R$ direction in accordance with Fleming's left-hand rule and is bent with a curvature of the radius $\rho_0$. The radius $\rho_0$ of this equilibrium orbit 4 can be expressed by the following equation:

$$\rho_0 = P/(e.By) \quad (1)$$

where P is the momentum of the electrons; e is the charge of the electrons; and By is the generated magnetic field in the y-axis direction of the upper and lower coils 31, 32.

The y-axis is an axis parallel to the z-axis and related to the equilibrium orbit 4, and the x-axis, which will be described below, is an axis in the same direction as the radius R of the polar coordinate with respect to the equilibrium orbit 4.

The high-frequency cavity 8 accelerates the charged particles, and the six-pole electromagnets 7 correct any unevenness in the radial direction of the magnetic fields of the deflecting electromagnets 3, any chromaticity, etc.

When the charged particles circulating along the equilibrium orbit 4 are thus deflected by the magnetic fields of the deflecting electromagnets 3, the electromagnetic wave due to the braking radiation is emitted as radiation from the radiant beam lines 5 in the tangential directions of the equilibrium orbit 4.

Since the electron beam is making a betatron oscillation around the equilibrium orbit 4, a uniform magnetic-field distribution (a good magnetic-field area) of about $10^{-4}$ to $10^{-3}$ is generally required in a direction perpendicular to the electron-beam direction n (mainly, the direction of R, i.e., the x-axis direction) over a range of several centimeters or more around the central orbit. In the case where the magnetic distribution of the superconducting deflecting coils 31 and 32 is uneven, the equilibrium orbit 4 of the electron beam deviates from the center of the upper and lower coils 31 and 32. If this deviation exceeds a predetermined value, the electron beam strikes the vacuum chamber 10 and is lost.

FIG. 5 is a characteristic diagram showing the distribution in the R (x-axis) direction of the magnetic field By in the deflecting electromagnet 3 as obtained by calculation. Supposing the inner radius $\rho_1$ and the outer radius $\rho_2$ of the upper and lower coils 31 and 32 to be 315.8 mm and 675.8 mm respectively, the diagram shows the value of (By − Byo)/Byo expressed as a percentage when the distance between the upper and lower coils 31 and 32 is 252 mm. Here, Byo represents the center of the equilibrium orbit 4, i.e., $\omega = 50$ mm. The radial position of the equilibrium orbit 4 of the $R = \rho_0$ ($x = 0$) obtained from the equation (1) is:

$$\rho_0 = 495.8 \text{ mm}$$

As is apparent from FIG. 5, the position where the magnetic field By is at its peak is some position where the radius is somewhat larger than $R = \rho_0$ (the outer side) when $\theta = 90°$. The closer $\theta$ is to 0°, the nearer is the peak position to the side of the inner diameter $\rho_1$ (the inner side). Thus, even if the equilibrium orbit 4 for the electron beam is fixed, the absolute value of the magnetic field to which the beam on the equilibrium orbit 4 is subjected varies considerably between the entrance of the deflecting electromagnets 3 and the central section. This variation is due to the banana-like configuration of the upper and lower coils 31 and 32.

FIG. 6 is a sectional view which shows, by way of example, a steering magnet in the charged-particle apparatus shown in "Designing UVSOR Storage Rings" No. UVSOR-9, December 1982, by the Molecular Science Institute.

In the steering magnet shown, an iron core 13 comprises a return yoke 14 and magnetic poles 15. A coil 16 is wound around the return yoke 14, and the above-mentioned magnetic poles 15 are arranged with a vacuum chamber 10 therebetween. Charged particles 17 pass through this vacuum chamber 10 along an equilibrium orbit 4.

FIG. 7 is a side view of the steering magnet shown in FIG. 6. The return yoke 14 has a width $W_1$ of, for example, 100 mm, and the coil 16 has a width $W_2$ of, for example, 300 mm.

Next, the operation of the steering magnet for a charged-particle apparatus having the above-described construction will be described. When electricity is supplied to the coil 16, a magnetic field is generated between the magnetic poles 15 in the horizontal or vertical direction, depending on the direction in which the magnetic poles 15 are installed. The steering magnet causes an electromagnetic force to be exerted in the direction of the vector product of the magnetic field generated between the magnetic poles 15 and the electric current due to the movement of the charged particles 17 passing between the magnetic poles 15, thereby slightly deflecting the orbit of the particles. Usually, steering magnets are used together with deflecting electromagnets 3 and four-pole electromagnets 6, etc. in a charged-particle accelerating ring, a charged-particle storage ring, etc. In such cases, all the steering magnets exhibit independent magnetic-field-output components, and the respective functions of these steering magnets with respect to the charged particles 17 are fixed independently.

The problem with the deflecting electromagnets in the conventional charged-particle apparatuses shown in FIGS. 1 to 5 is that the absolute value of the magnetic fields on the equilibrium orbit greatly varies from place to place, so that the equilibrium orbit for the electron beam suffers deviation. Furthermore, as shown in FIGS. 6 and 7, the electromagnets of conventional charged-particle apparatuses have the following problem: when, for instance, a single steering magnet is provided for each charged-particle storage ring, a space corresponding to the width $W_2$ (about 300 mm) of the steering magnet has to be secured in the direction of the charged-particle orbit (see FIG. 7). Since several, in some cases ten or more, steering magnets are mounted on one storage ring or accelerating ring, the peripheral length of the ring has to be considerable, resulting in a very large ring.

SUMMARY OF THE INVENTION

This invention has been made with a view to eliminating the above problem. It is accordingly an object of this invention to provide an electromagnet which is equipped with space-saving steering magnets, small-sized four-pole coils for focusing, etc., as well as to provide an electromagnet in which the magnetic-field distribution on the equilibrium orbit is adjustable to a desired condition by partially changing the curvature of the principal coil, or by causing the thickness of the iron core extending along and surrounding this principal coil to be different at different positions on the equilibrium orbit.

In accordance with a first form of this invention, there is provided a deflecting electromagnet for a charged-particle apparatus in which cavities through which a vacuum chamber runs are formed in clamping plates of the iron core thereof, the above-mentioned cavities containing small-sized coils utilizing the iron core as the magnetic path and adapted to be used to adjust the charged-particle orbit. In accordance with a second form of this invention, there is provided a deflecting electromagnet in which the curvature of the banana-shaped coils is larger in the end portions than in the central portion, thereby leveling the magnetic-field distribution on the equilibrium orbit. In accordance with a third form of this invention, there is provided a deflecting electromagnet in which the thickness of the iron core is different at different positions along the equilibrium orbit for charged particles, thereby obtaining some desired magnetic-field distribution. It should be noted, in particular, that the first and third forms of this invention are not restricted to the structure of the deflecting electromagnets for a charged-particle apparatus but can be applied to other types of electromagnets installed in a charged-particle apparatus.

DESCRIPTION OF THE PREFERRED EMBODIMENTS

Figure 1:
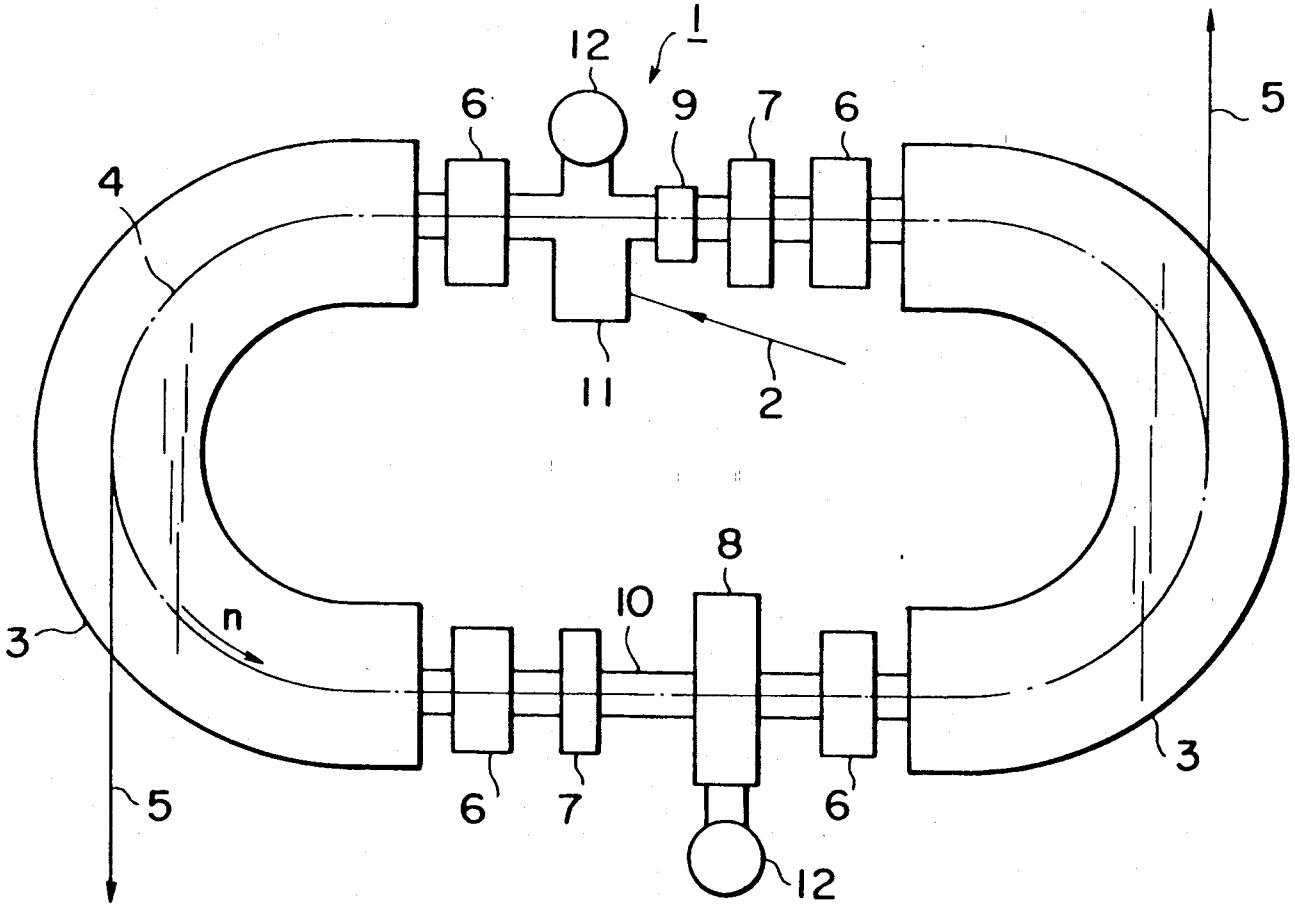
FIG. 1 PRIOR ART
FIG. 1 is a plan view of a conventional charged-particle apparatus.
Figure 2:
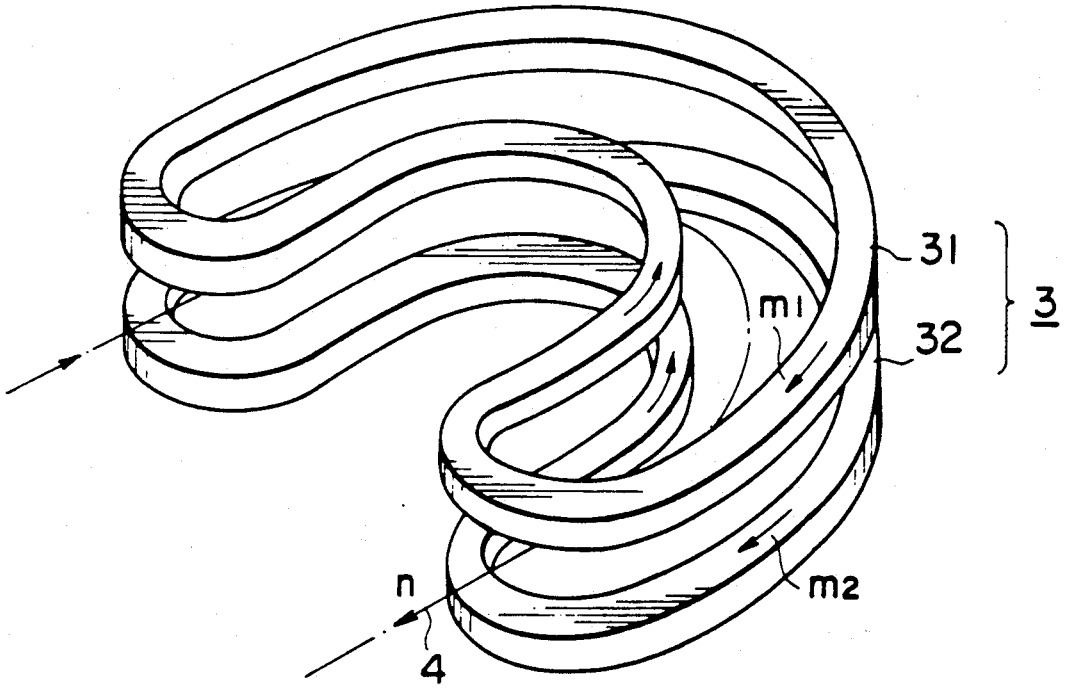
FIG. 2 PRIOR ART
FIGS. 2 to 4 are a perspective view, a plan view, and a side view, respectively, of the upper and lower coils of a deflecting electromagnet in the apparatus shown in FIG. 1.
Figure 3:
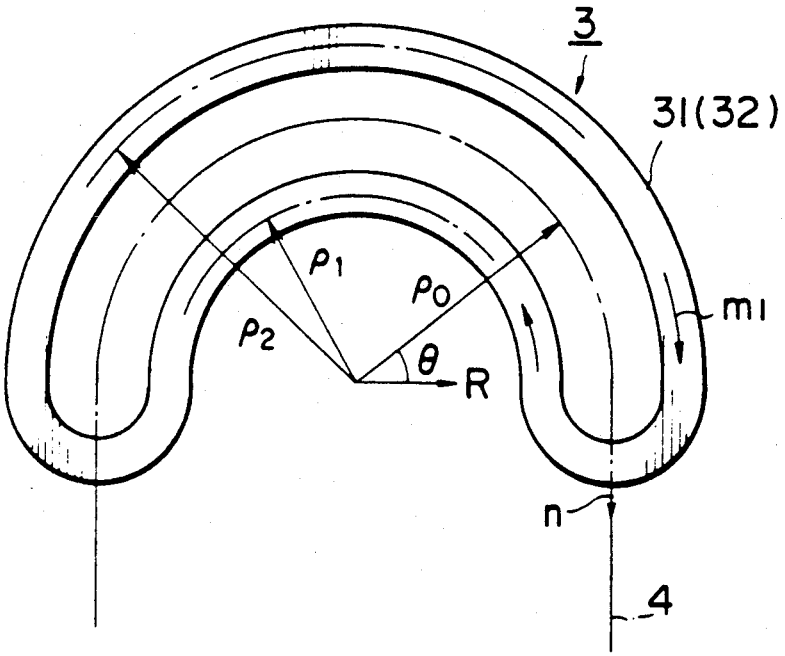
FIG. 3 PRIOR ART
Figure 4:
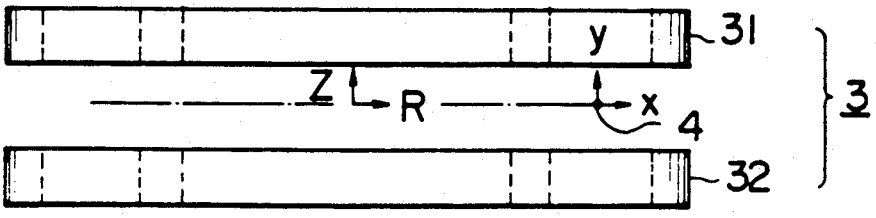
FIG. 4 PRIOR ART
Figure 5:
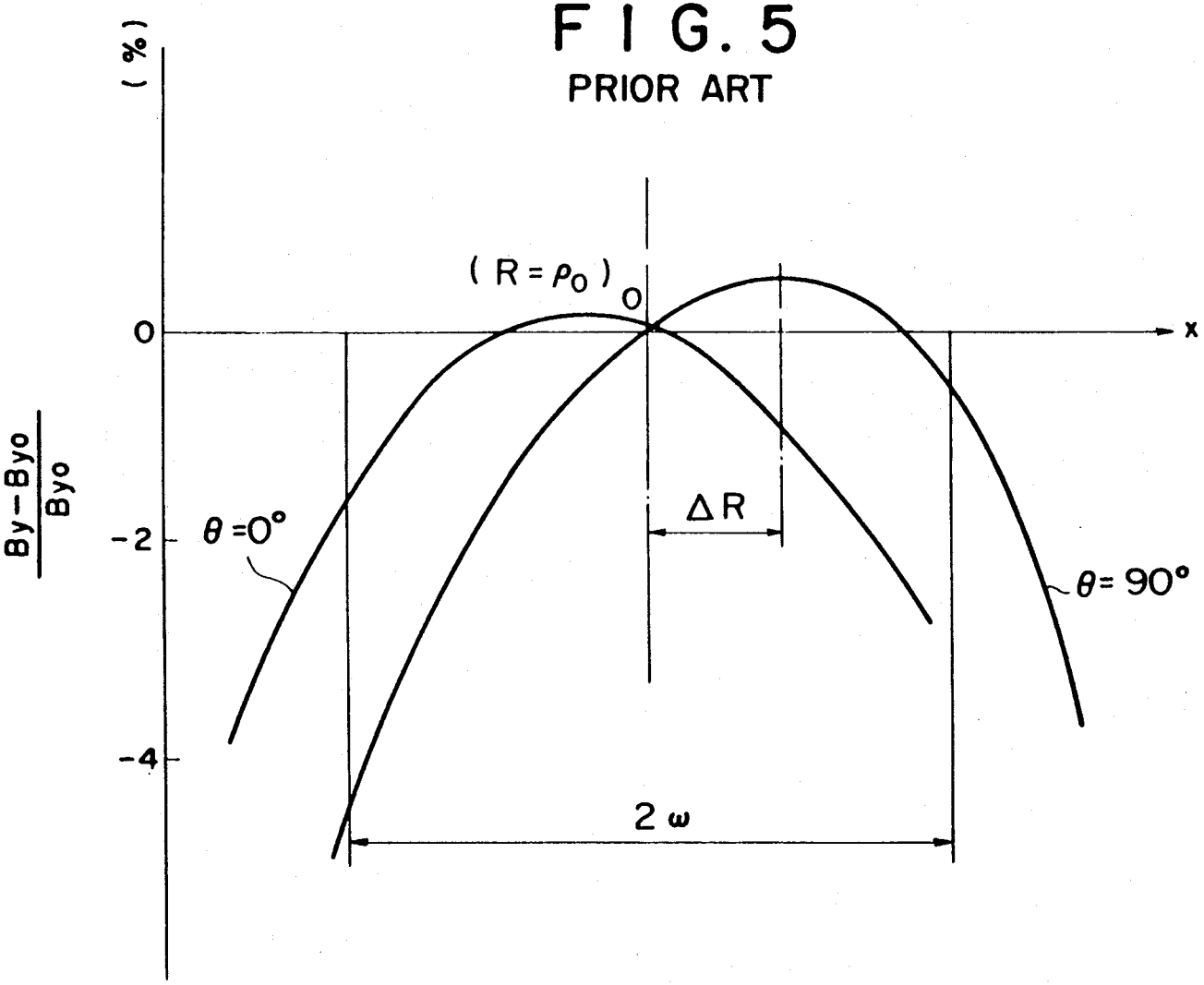
FIG. 5 PRIOR ART
FIG. 5 is a diagram showing the magnetic-field distribution, as obtained by numerical calculation, of the coil arrangement of FIG. 4.
Figure 6:
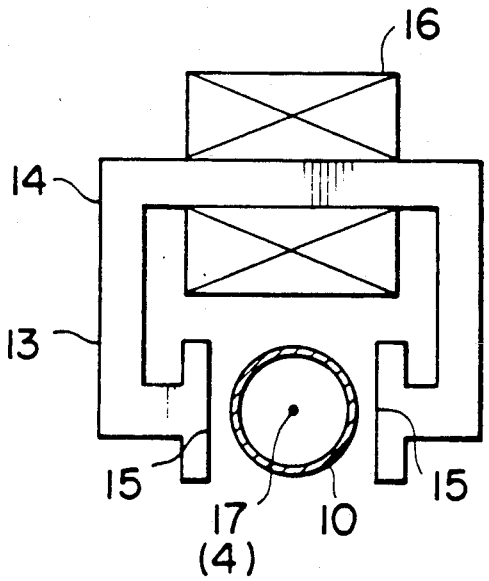
FIG. 6 PRIOR ART
FIG. 6 is a front view of an example of a steering magnet in a conventional charged-particle apparatus.
Figure 7:
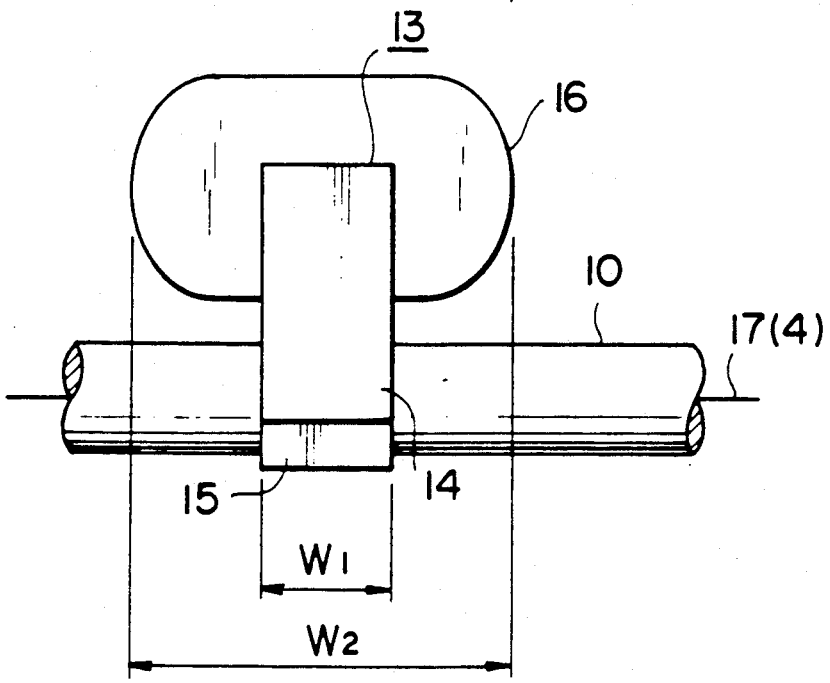
FIG. 7 PRIOR ART
FIG. 7 is a side view of the steering magnet shown in FIG. 6.

Embodiments of this invention will now be described with reference to the attached drawings, in which the components identical or corresponding to those of the above-described conventional apparatuses will be referred to by the same reference numerals.

Figure 8:
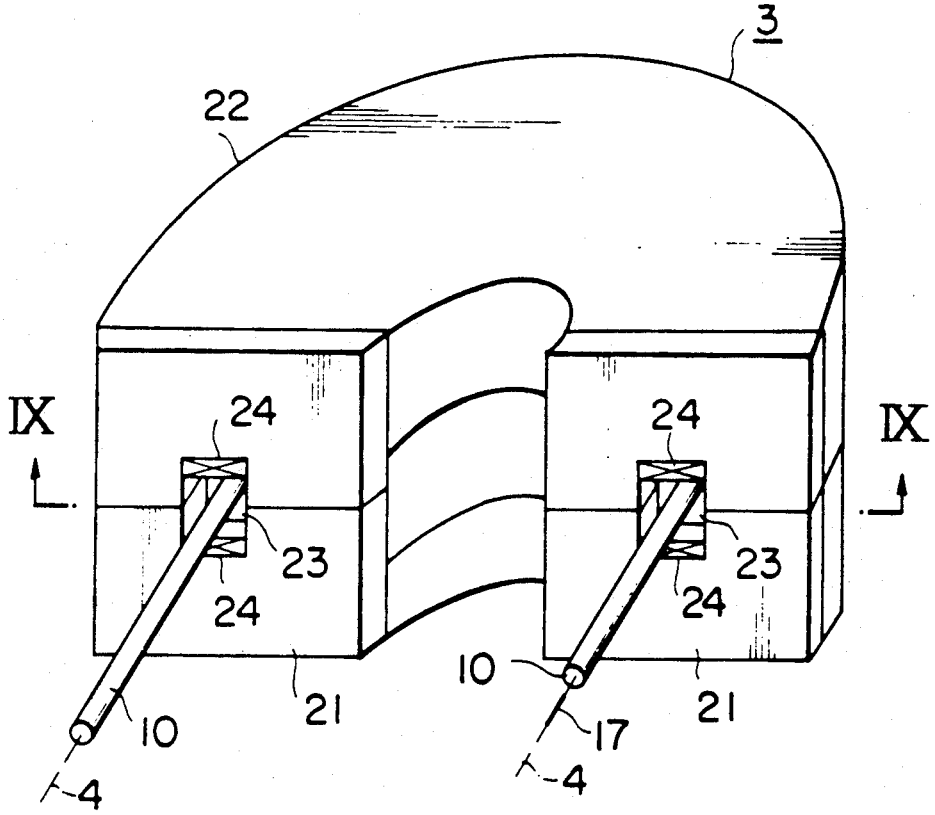
FIG. 8 is a perspective view of a deflecting electromagnet in accordance with a first embodiment of the first form of this invention, which is equipped with steering magnets and adapted to be used in a charged-particle apparatus.

FIG. 8 is a perspective view of a deflecting electromagnet in accordance with a first embodiment of the first form of this invention. The electromagnet shown includes clamping plates 21 which are stuck fast to return yokes 22 to form an iron core. An equilibrium orbit 4 for charged particles 17 is provided such that it runs through cavities 23 formed in the clamping plates 21, the charged particles 17 moving along the equilibrium orbit 4, which has a race-track-like configuration. Steering coils 24, which constitute steering magnets, are provided above and below each of the cavities 23.

Figure 9:
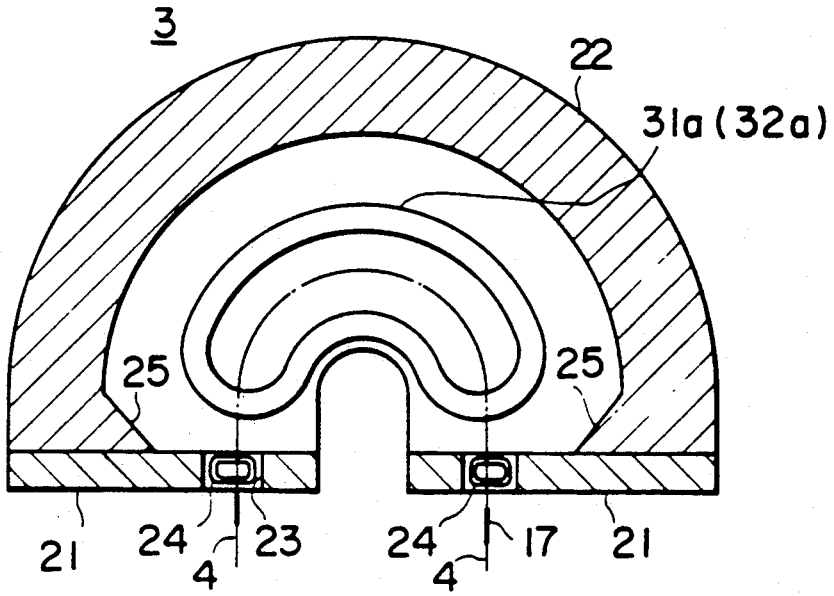
FIG. 9 is a sectional view taken along the line IX—IX of FIG. 8.

FIG. 9 is a sectional view taken along the line IX—IX of FIG. 8, i.e., along the plane including the equilibrium orbit 4. The reference numerals 31*a* and 32*a* indicate the coils constituting the principal coil, i.e., the upper and lower coils, of a deflecting electromagnet 3, each of the coils consisting of an outer and an inner coil which form a loop. The upper and lower coils 31*a* and 32*a* generate a magnetic field which is perpendicular to the plane of FIG. 9 so that the charged particles 17 may be deflected and the equilibrium orbit 4 bent. The end sections of the return yokes 22 are partly swelled to form reinforced end sections 25. Thus, the cross-sectional area of the iron core is made larger where it is connected to the clamping plates 21.

The clamping plates 21 are provided with a view to preventing the magnetic field generated by the electromagnet 3 from affecting the equipment, which is in contact with this electromagnet 3, due to a leakage magnetic field. Because of the magnetic shield provided by the clamping plates 21, the leakage magnetic field due to the deflecting electromagnet 3 is next to nothing in those portions of the equilibrium orbit 4 beyond these clamping plates. The pair of steering coils 24, arranged around each cavity 23 of the clamping plates 21, generates a magnetic field whose principal component is perpendicular to the plane formed by the equilibrium orbit 4. Because of these magnetic fields, the charged particles 17 receive a horizontal Lorentz force, which causes the charged particles to be finely deflected, thereby effecting a fine adjustment of the equilibrium orbit 4. This function is completely identical to that of conventional steering magnets. It is to be noted, however, that the required magnetic circuit is formed not only by the return yokes but also by the clamping plates 21, which are attached to the deflecting electromagnet 3. That is, the clamping plates 21 not only serve as the magnetic shield plates but also have the function of a return yoke constituting the magnetic circuit of a steering magnet.

Figure 10:
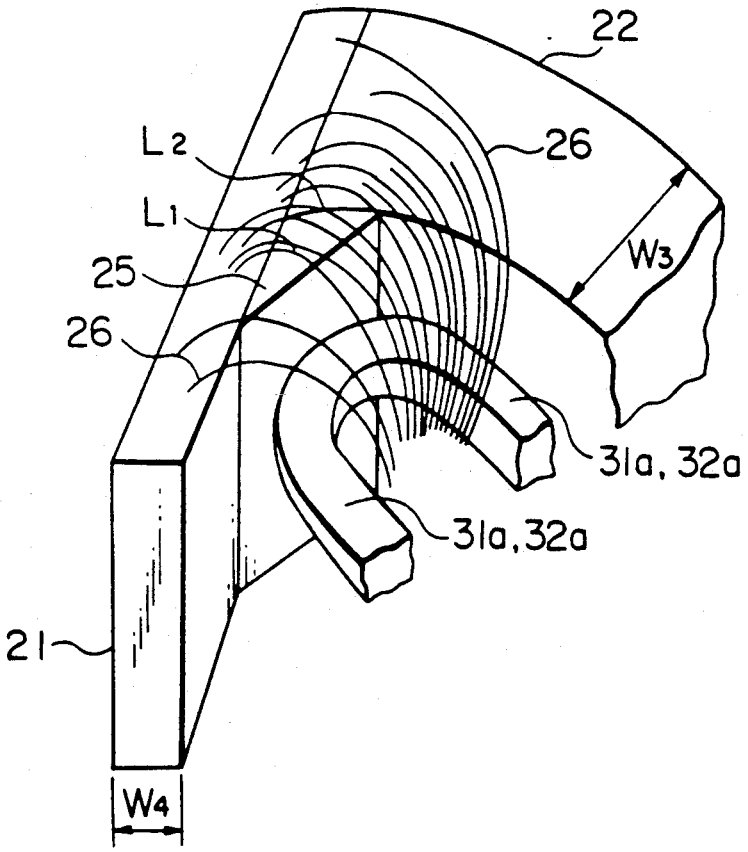
FIG. 10 is an enlarged perspective view of a reinforced end section of the deflecting magnet shown in FIG. 9.

FIG. 10 is a perspective sectional view, partly broken away, of one of the reinforced end sections of the deflecting electromagnet 3. Magnetic lines of force 26 indicate the magnetic field generated when electricity is supplied to the upper and lower coils 31*a* and 32*a* of the principal coil. Where the magnetic lines of force 26 are dense, the magnetic field is relatively strong, and, where the magnetic lines of force 26 are sparse, the magnetic field is relatively weak. In FIG. 10, the variation in density of the magnetic lines of force 26 is visualized in accordance with the result of a non-linear three-dimensional quantitative analysis of the magnetic field including the return yokes 22.

The cross-sectional area of the return yokes 22 and that of the reinforced end sections 25 thereof are larger than the cross-sectional area of the clamping plates 21. As a result, the magnetic reluctance of the return yokes 22 and of the reinforced end sections 25 is very small, so that they readily allow the magnetic lines of force 26 to pass, resulting in most of the magnetic lines of force 26 concentrating on the areas other than the clamping plates 21. In other words, the magnetic field is considerably weaker around the clamping plates 21, so that a sufficient magnetic shield effect can be obtained even with thin clamping plates. Accordingly, the clamping plates 21 can be made relatively thin, which means the space to be provided in the direction of the equilibrium orbit 4 may be small. As a result, the space available for installing a number of devices in the direction of the equilibrium orbit 4 can be enlarged. In other words, a small-sized charged-particle apparatus, for example, a small-sized particle accelerating ring or a small-sized particle accummulation ring, can be realized.

In the model used in the three-dimensional magnetic-field analysis, the width $W_3$ of the return yokes 22 was 450 mm, and the dimensions $L_1$, $L_2$ of the reinforced end sections 25 was 300 mm. In contrast, the width $W_4$ of the clamping plates 21 was 150 mm, i.e., one third of the width $W_3$ of the return yokes 22. The result of the magnetic-field analysis showed that, when the magnetic flux density of the central magnetic field of the upper and lower 31*a* and 32*a* of the principal coil was 4.5 T, the leakage magnetic field beyond the clamping plates 21 was substantially 0, thus providing a sufficient magnetic-field-shield effect.

While in the above embodiment the steering coils 24 are installed above and below each of the cavities 23, they may also be arranged to the right and left of each cavity. In that case, a horizontal magnetic field is generated which is in the same plane as the equilibrium orbit 4 by each pair of steering coils 24. By virtue of the mutual action between these magnetic fields and the charged particles 17, the equilibrium orbit 4 is finely adjusted in the vertical direction.

Figure 11:
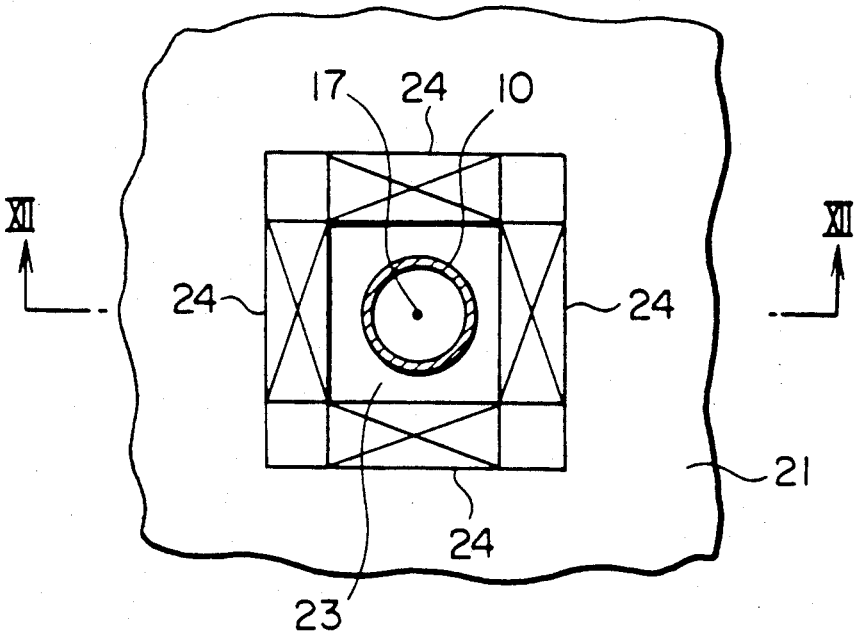
FIG. 11 is a partial front view of a steering magnet provided in a deflecting electromagnet in accordance with a second embodiment of the first form of this invention.
Figure 12:
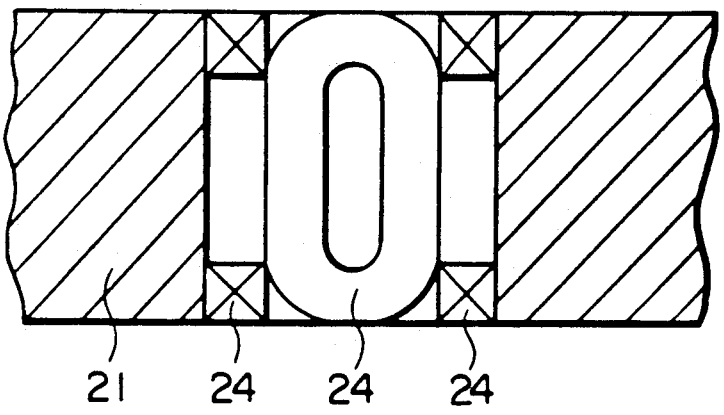
FIG. 12 is a sectional view taken along the line XII—XII of FIG. 11.

Further, while in the above embodiment either the horizontal or the vertical components of the magnetic-field output of the steering magnets are generated, it is also possible, as shown in FIGS. 11 and 12 (which illustrate a second embodiment of the first form of this invention), steering coils 24 may be arranged on all four sides of each cavity 23. The steering coils 24 provided above and below each cavity 23 generate a deflecting force for the charged particles 17 in the horizontal direction, and the steering coils 24 to the right and left of each cavity generate a deflecting force for the charged particles in the vertical direction.

Figure 13:
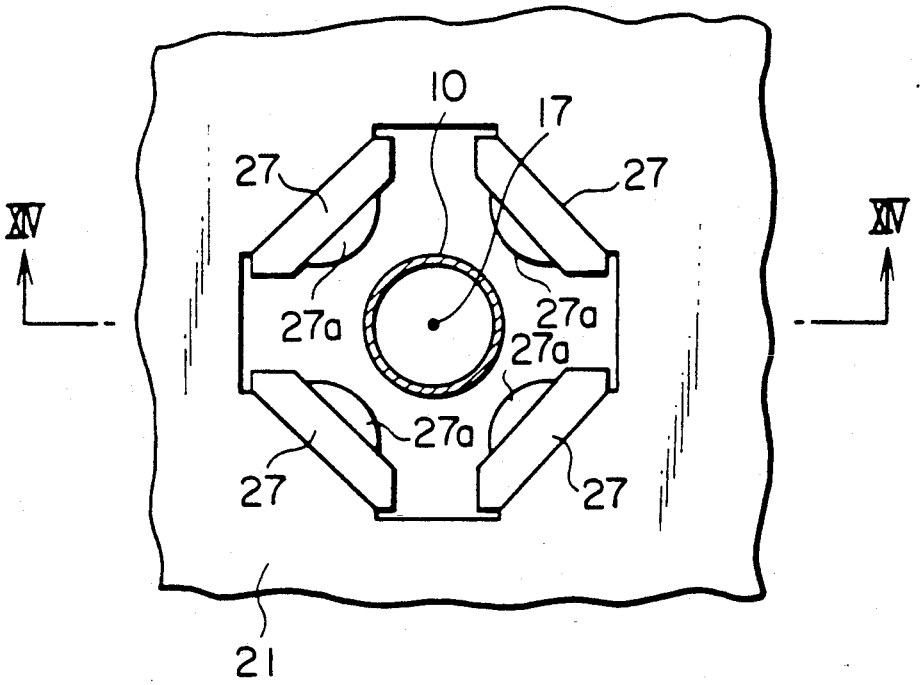
FIG. 13 is a partial front view of a four-pole focusing electromagnet provided in a deflecting electromagnet in accordance with a third embodiment of the first form of this invention.
Figure 14:
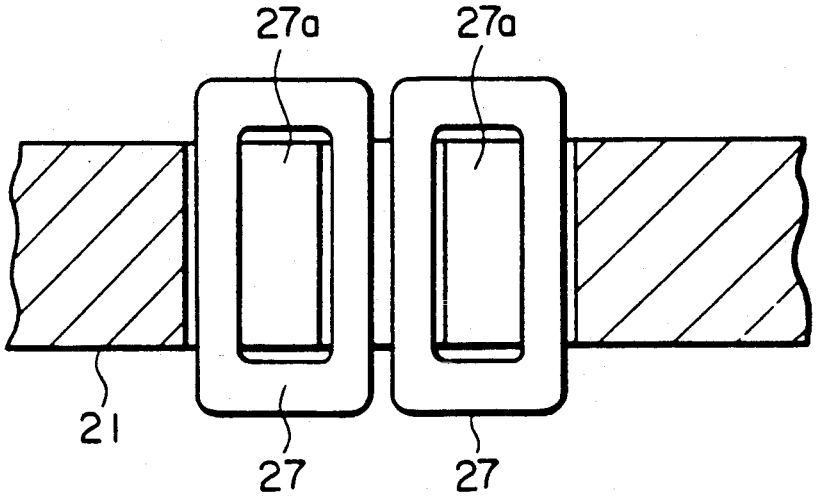
FIG. 14 is a sectional view taken along the line XIV—XIV of FIG. 13.

FIG. 13 is a partial side view showing a third embodiment of the first form of this invention, and FIG. 14 is a sectional view taken along the line XIV—XIV of FIG. 13. In this embodiment, four four-pole magnetic poles 27*a* are provided which are surrounded by the same number of four-pole coils 27. The protruding portion of each four-pole magnetic pole 27*a* has a hyperbolical configuration. The four-pole coils 27 and the four-pole magnetic poles 27*a* form, together with that portion of the clamping plate 21 surrounding the four-pole magnetic poles 27*a*, a four-pole electromagnet adapted to focus charged particles 17.

Usually, a four-pole electromagnet is constructed as a component independent of other types of electromagnets, such as deflecting electromagnets, which constitute the requisite components of a charged-particle apparatus. According to the above embodiment, a four-pole electromagnet is formed utilizing a part of the iron core of a deflecting electromagnet.

While in the above-described first and third embodiments steering coils 24 and four-pole coils 27 are directly attached to sections around the cavity 23 of each clamping plate 21, the cavities 23 may in some cases be smaller depending on the design of the steering magnets and of the vacuum chamber 10. In such cases, the operation of mounting the steering coils 24 and the four-pole coils 27 can be extremely difficult or impossible. The construction shown in FIG. 15 has been conceived with a view to eliminating this problem.

Figure 15:
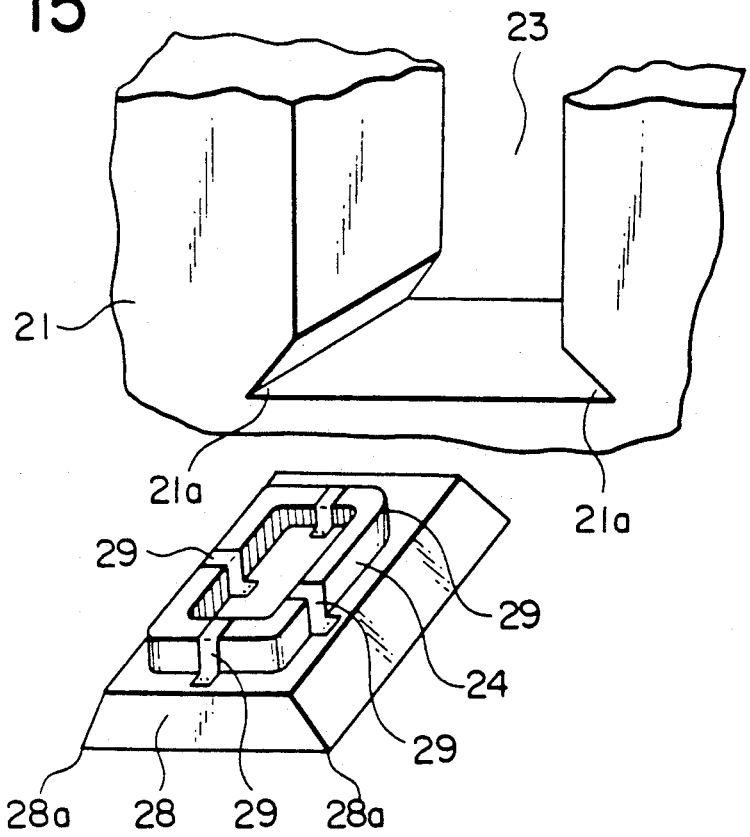
FIG. 15 is an exploded perspective view of a steering magnet to be attached to a deflecting electromagnet in accordance with a fourth embodiment of the first form of this invention.
Figure 16:
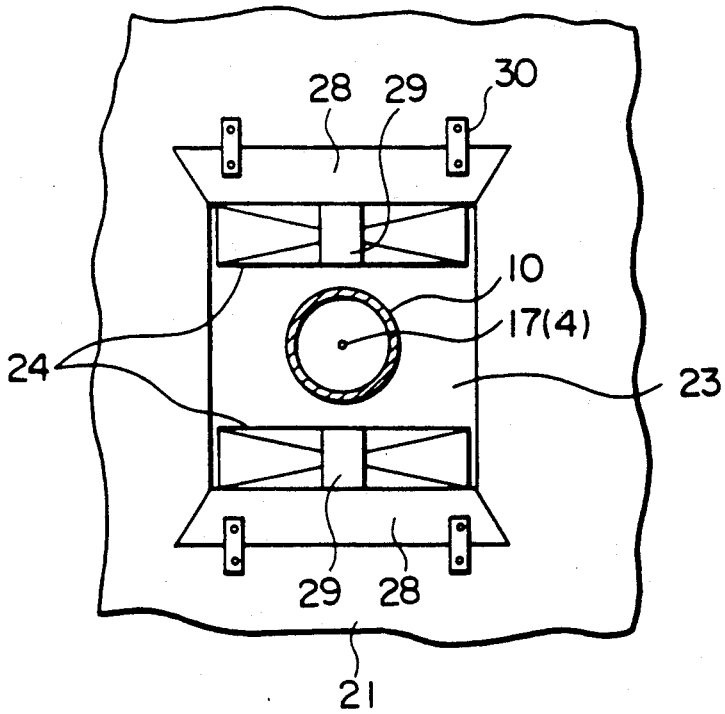
FIG. 16 is a partial front view of the steering magnet of FIG. 15 after assembly.

Referring to FIG. 15, the reference numeral 28 indicates an iron pedestal both end sections of which are formed as keys 28*a*, the bottom surface of the iron pedestal 28 being at an angle less than 90° with respect to the side surfaces thereof. A steering coil 24 is fixed to the upper surface of the iron pedestal 28 by means of fastening members 24. The iron pedestal 28 is inserted into key seats 21*a*, which constitute the fitting sections provided on the side of the clamping plate 21, and is fixed in these key seats. As shown in FIG. 16, the iron pedestal 28 is fixed to the clamping plate 21 by means of fixing members 30.

The assembly sequence of the embodiment shown in FIGS. 15 and 16 will now be described. First, the steering coil 24 is fixed to the iron pedestal 28 in a wide space, i.e., outside the cavity 23. This is possible because the iron pedestal 28 and the clamping plate 21 are prepared as separate components. Thus, the steering coil 24 can be mounted on the iron pedestal 28 before fixing the latter to the clamping plate 21. After mounting the steering coil 24, the keys 28*a* provided on both ends of the iron core 28 is inserted into the key seats 21*a*, and the iron core 28 is fixed to the clamping plate 21 by means of the fixing members 30 provided on the surface of the clamping plate 21. The gap between the bottom surface of the iron core 28 and the clamping plate 21 is quite small, so that this does not affect the magnetic circuit at all.

Figure 17:
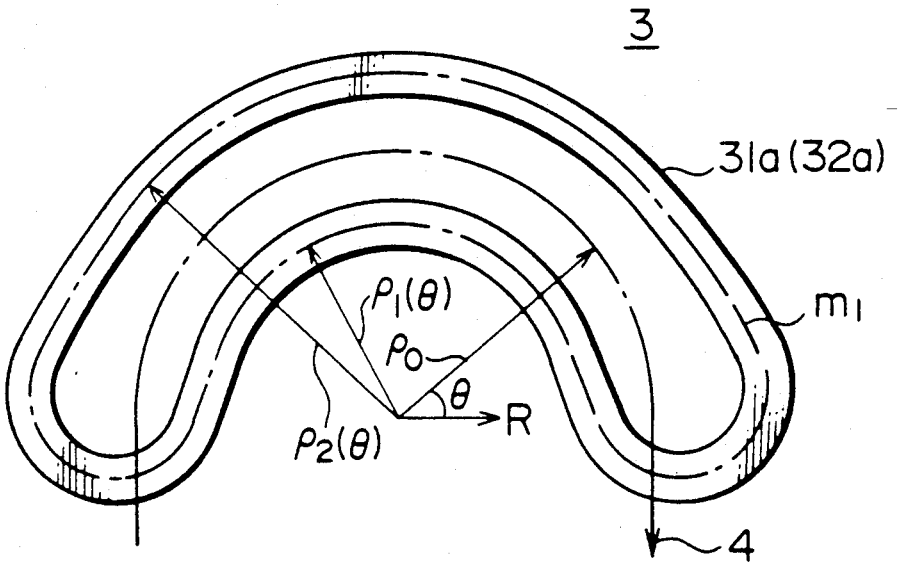
FIGS. 17 and 18 are a front view and a side view, respectively, of the principal coil of a deflecting electromagnet in accordance with a first embodiment of the second form of this invention.
Figure 18:
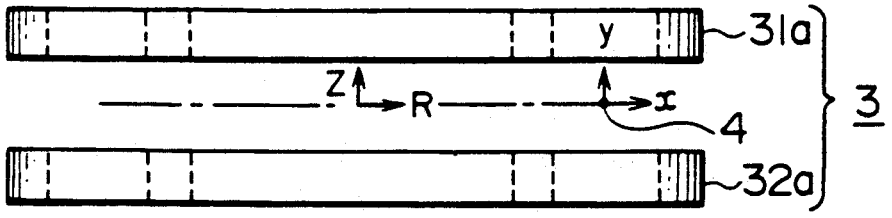

Next, the second form of this invention will be described with reference to FIGS. 17 and 18 illustrating an embodiment thereof.

In the drawings, the reference numerals 31*a* and 32*a* indicate the upper and lower coils of a deflecting electromagnet in accordance with this embodiment. As in conventional apparatuses, these coils 31*a* and 32*a* have a banana-like configuration. The respective inner and outer radii $\rho_1$ and $\rho_2$ of these coils are functions of the angle $\theta$. Thus, they can be expressed as: $\rho_1(\theta)$ and $\rho_2(\theta)$. The radius of curvature is larger in the end sections than in the middle section of the deflecting coil.

That is, the respective values of $\rho_1$ and $\rho_2$ can be expressed by the following inequalities:

$$\rho_1(\theta=0^\circ \text{ or } 180^\circ)>\rho_1(\theta=90^\circ)$$

$$\rho_2(\theta=0^\circ \text{ or } 180^\circ)>\rho_2(\theta=90^\circ)$$

The radius $\rho_0$ of the equilibrium orbit is in the following range:

$$\rho_0 > \frac{\rho_1+\rho_2}{2} \quad (\theta = 90^\circ)$$

Thus, the peak position of the magnetic-field distribution in the x-direction is in concordance with the position of $\rho_0$.

Figure 19:
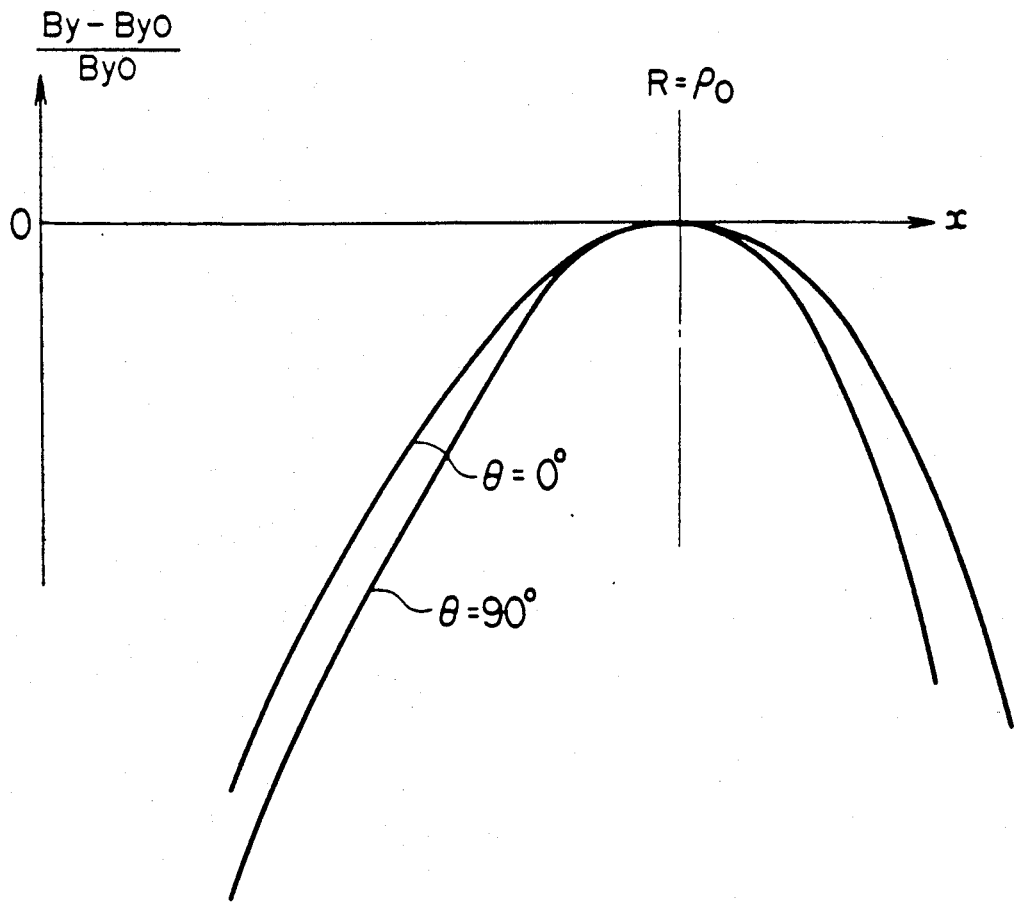
FIG. 19 is a diagram showing the magnetic-field distribution, as obtained by numerical calculation, of the coil shown in FIG. 17.

Electricity was supplied to the upper and lower coils 31*a* and 32*a* of this deflecting electromagnet in the $m_1$-direction and the magnetic-field distribution in the $\theta$-direction was obtained by numerical calculation. FIG. 19 shows the result of this numerical calculation.

As is apparent from this drawing, the peak value of the magnetic-field distribution in the x-direction of the magnetic field generated by the upper and lower coils 31*a* and 32*a* is in concordance with the equilibrium orbit 4 of the electron beam. This is because the respective inner and outer radii $\rho_1$ and $\rho_2$ of the upper and lower coils 31*a* and 32*a* are functions of $\theta$.

Next, the third form of this invention will be described with reference to embodiments thereof.

The third form of this invention is the same as the above-mentioned ones in that at least a pair of banana-shaped coils are used to form a deflecting electromagnet and that the radius of curvature is different between the respective end sections of the coils and the middle sections thereof. As stated above, a deflecting electromagnet is often equipped with an iron core which surrounds the upper and lower coils 31*a* and 32*a*. This iron core is used as a magnetic shield which serves to prevent the magnetic field generated by the upper and lower coils 31*a* and 32*a* from leaking to the exterior of the deflecting electromagnet. Since this iron core is generally made of a material having a high permeability, the magnetization thereof results in the central magnetic field being augmented. Accordingly, the magnetomotive force of the upper and lower coils in the case where an iron core is used can be less than in the case where no iron core is used. This is another reason why the iron core is used.

This does not mean, however, that using an iron core leads to an improvement in the magnetic-field distribution in a deflecting electromagnet. Thus, as in the above embodiments, the magnetic-field distribution is apt to be in disorder in the coil end sections.

Figure 20:
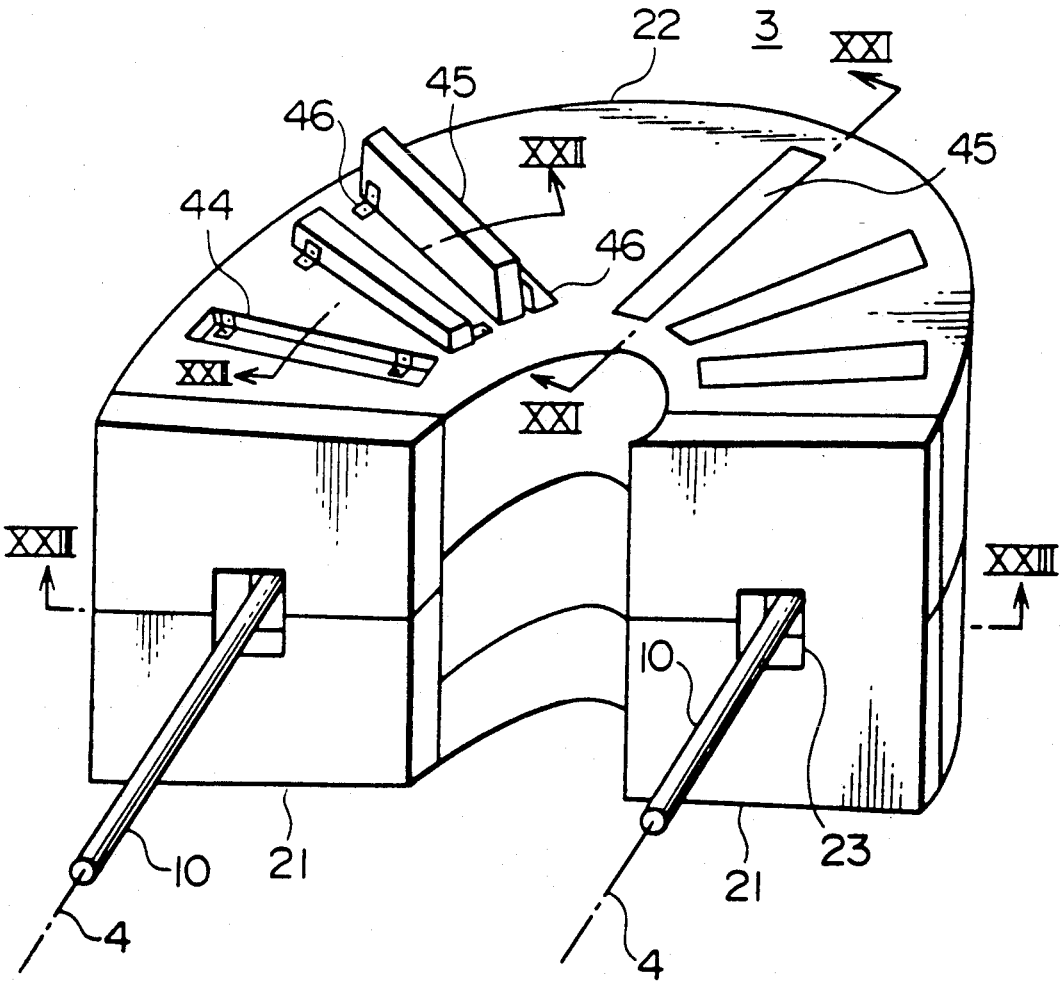
FIG. 20 is a perspective view of a deflecting electromagnet for a charged-particle apparatus in accordance with a first embodiment of the third form of this invention.

FIG. 20 is a perspective view of a deflecting electromagnet in accordance with a first embodiment of the third form of this invention. The return yokes 22 of the deflecting electromagnet shown is made of a material having a high permeability. Usually, an iron material is employed in the return yokes. The clamping plates 21, each having a cavity 23, are made of an iron material with a view to preventing the magnetic field from leaking in the direction of the equilibrium orbit 4. This arrangement is also adopted in the first and second forms of this invention. Provided on the return yokes 22 are iron-core slits 44, into which insertion plates 45 made of iron are inserted. After being inserted into the iron-core slits 44, which are situated at predetermined inserting positions, these insertion plates 45 are fixed to the return yokes by means of fixing plates 46.

Figure 21:
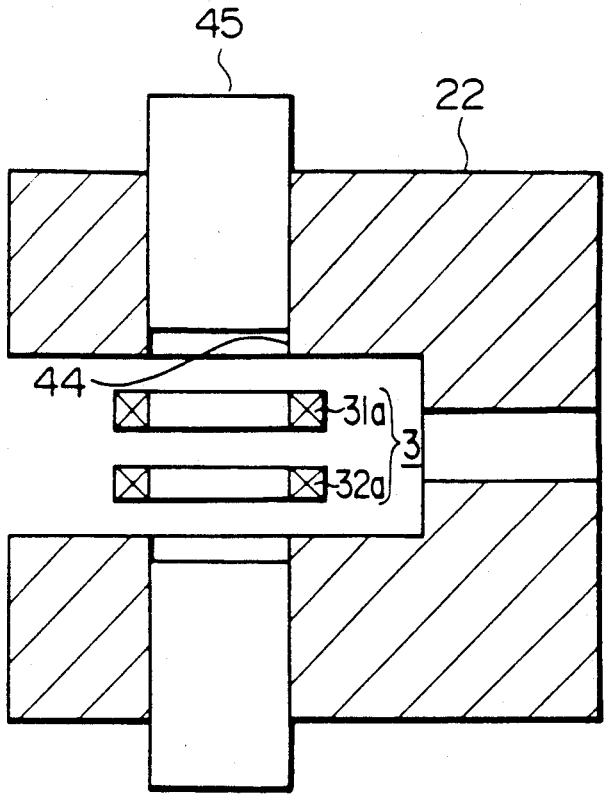
FIGS. 21 to 23 are sectional views taken along the lines XXI—XXI, XXII—XXII, and XXIII—XXIII, respectively, of FIG. 20.
Figure 22:
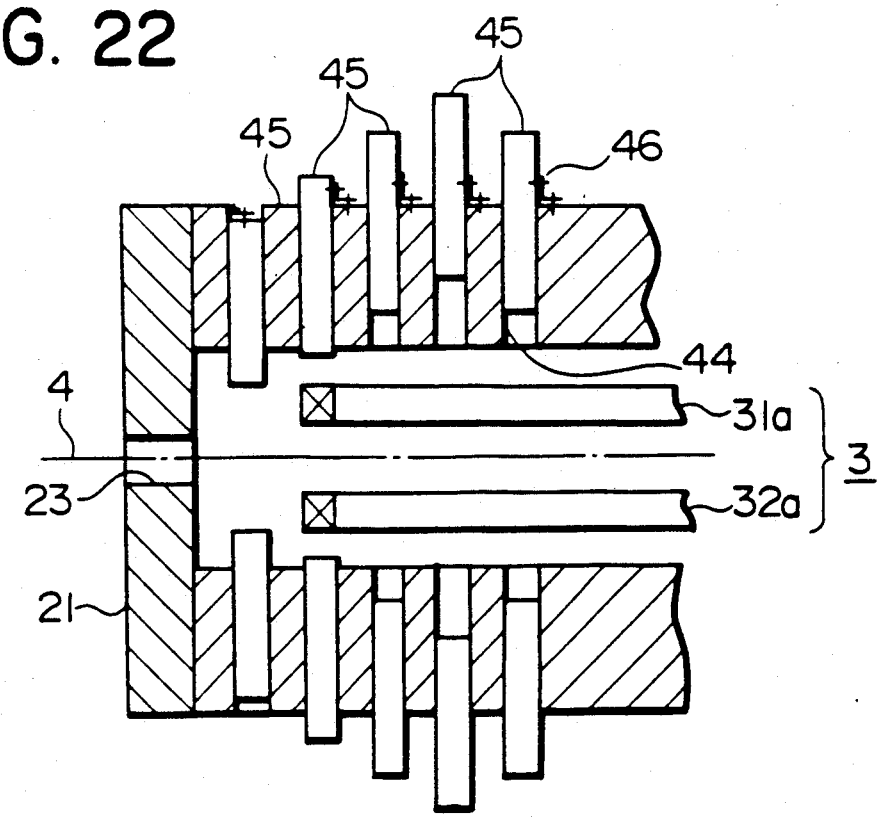
Figure 23:
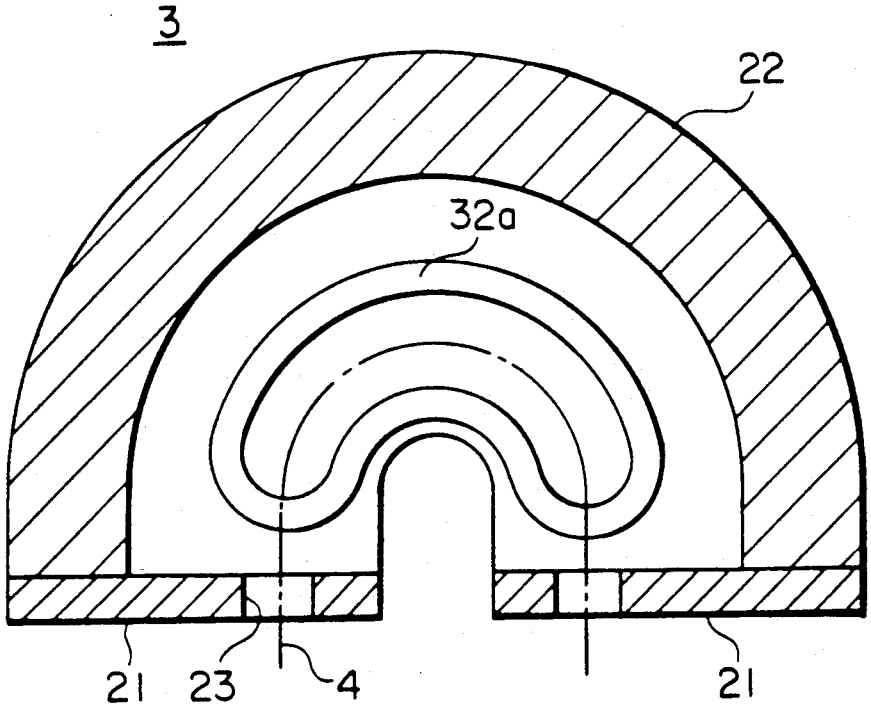

FIGS. 21 to 23 are sectional views taken along the lines XXI—XXI, XXII—XXII, and XXIII—XXIII of FIG. 20, respectively. This arrangement has been conceived with a view to making it possible to vary the magnetic reluctance of the return yokes 22. This is effected by appropriately inserting or extracting insertion plates 45. Thus, if it is desired that the magnetic-field strength be lowered in certain portions, the insertion plates 45 of those portions are extracted, which augments the magnetic reluctance in those portions of the return yokes 22.

Figure 24:
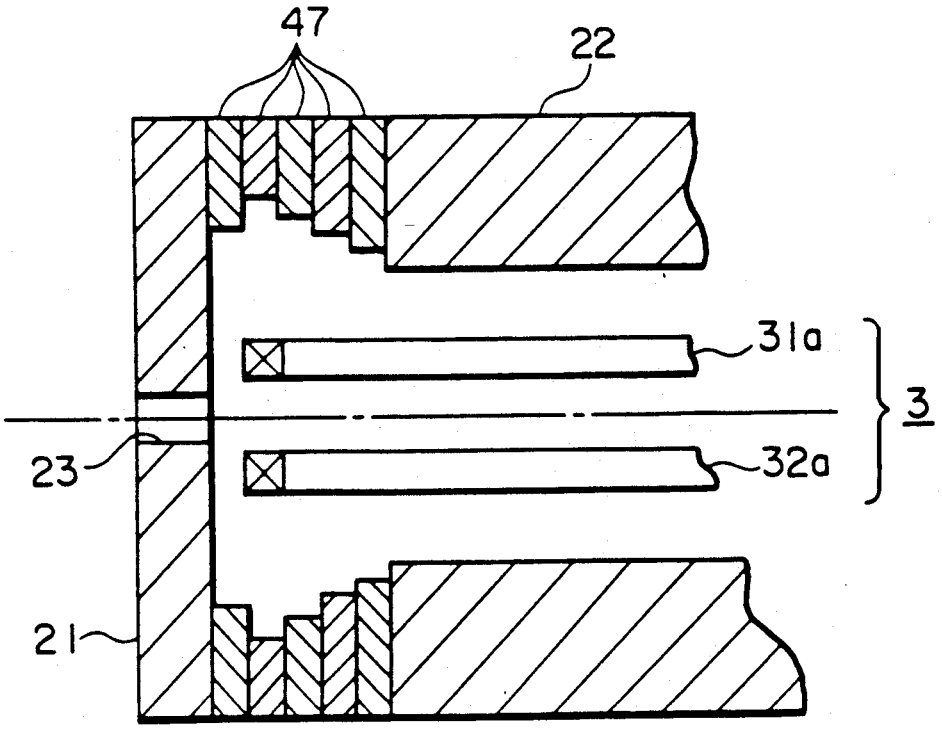
FIG. 24 is a sectional view of a deflecting electromagnet in accordance with a second embodiment of the third form of this invention.
Figure 25:
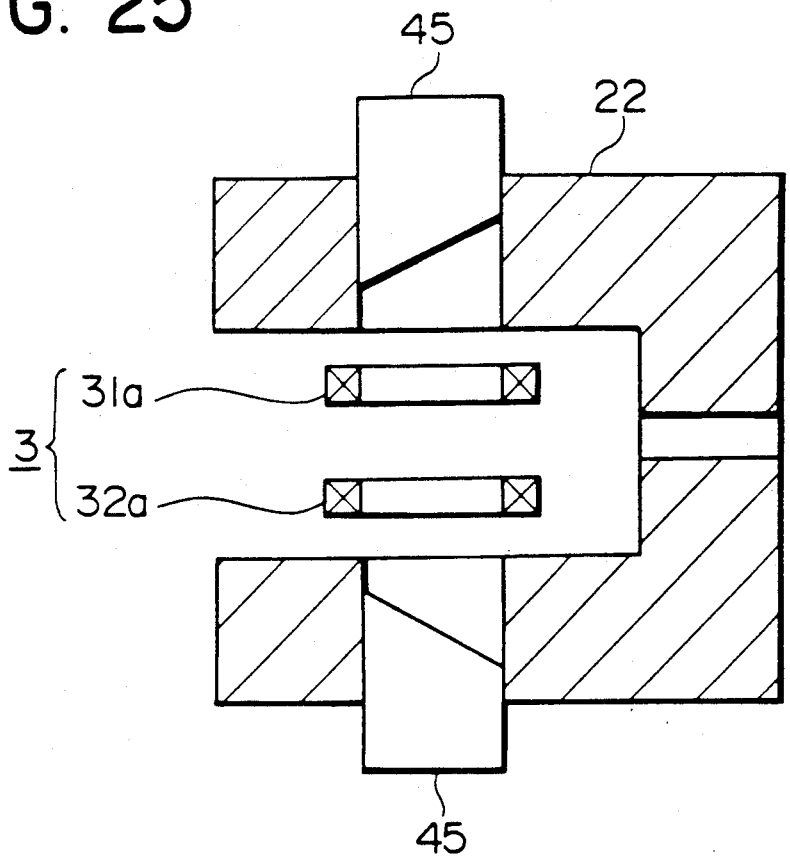
FIG. 25 is a sectional view of a deflecting electromagnet in accordance with a third embodiment of the third form of this invention.

Further, as in the second embodiment of the third form of this invention (shown in FIG. 24), adjusting plates 47 consisting of iron insertion plates may be incorporated into the return yokes 22 beforehand. Further, as in the third embodiment of the third form of this invention (shown in FIG. 25), each of the insertion plates 45 may have a slant end, thereby reducing the magnetic field error.

Figure 26:
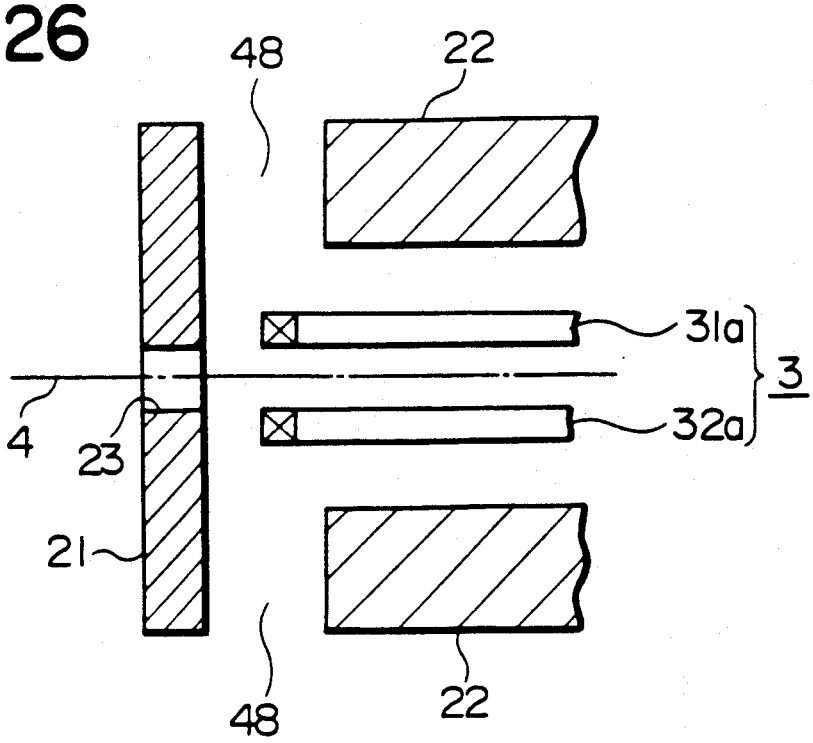
FIG. 26 is a sectional view of a deflecting electromagnet in accordance with a fourth embodiment of the third form of this invention.

Further, while in the above-described embodiments the insertion plates are inserted into the iron-core slits, it is also possible, as in the fourth embodiment of the third form of this invention (shown in FIG. 26), to provide end spaces 48 constituting an iron-core groove, leaving the end sections of the coils of a deflecting electromagnet uncovered. This arrangement proves advantageous when correcting the magnetic-field distribution, and in particular, when correcting the magnetic-field distribution in the $\rho$-direction.

Thus, this invention provides the following advantages: first, in accordance with the first form of this invention, cavities through which a vacuum chamber runs are formed in the iron core of a deflecting electromagnet, and small-sized coils using the iron core as the magnetic path and adapted to adjust the orbit for charged particles are provided in this iron core, so that it is not necessary to separately provide steering coils. Instead, the steering coils can be arranged in the iron core. Accordingly, the adjustment of the magnetic field can be effected with ease and the size of the entire apparatus can be diminished. In accordance with the second form of this invention, the radius of curvature of a pair or more of banana-shaped main coils of a deflecting electromagnetic is larger in the respective coil end sections than in the respective coil middle sections, thereby leveling the magnetic-filed distribution on the equilibrium orbit. In accordance with the third form of this invention, the iron core surrounding the main coils has one or more slits extending through it in the thickness direction (the direction perpendicular to the equilibrium orbit). The thickness of the iron core is made different in different positions along the equilibrium orbit according to whether insertion plates are inserted into the corresponding slits as well as according to the depth of insertion, thereby making it possible to obtain an electromagnet for a charged-particle apparatus in which the magnetic-distribution on the equilibrium orbit is in an optimum condition. It is further to be noted that the first and third forms of this invention, in particular, are not restricted to the deflecting electromagnets of a charged-particle apparatus, but can be applied to other types of electromagnets in a charged-particle apparatus.

These forms of this invention should not be construed as restricted to the above-described embodiments.

We claim:

1. An electromagnet for a charged-particle apparatus, comprising:

a principle coil equipped with at least one pair of coils arranged with an equilibrium orbit for charged particles therebetween and extending along said equilibium orbit;

an iron core composed of return yokes surrounding and extending along said principal core, said return yokes providing a predetermined magnetic field density at both ends of said return yokes, and clamping plates provided at said both ends of said return yokes and having cavities through which said equilibrium orbit for charged particles runs; and steering magnets each composed of at least a pair of coils which are provided at opposed positions in each of said cavities formed in said clamping plates and which are arranged with said equilibrium for charged particles therebetween.

2. An electromagnet as claimed in claim 1, wherein end sections of the return yokes of said iron core, wherein the return yokes are connected to said clamping plates comprise reinforced end sections for augmenting the cross-sectional area of said iron core.

3. An electromagnet as claimed in claim 1, wherein each of said steering magnets provided in the cavities of said clamping plates consists of two pairs of steering coils, each pair of steering coils being arranged at opposed positions with said equilibrium orbit for charged particles therebetween, said two pairs of steering coils in each cavity being arranged in such a manner that a straight line connecting the coils of one pair to each other is at right angles to a straight line connecting the coils of the other pair to each other.

4. An electromagnet as claimed in claim 1, wherein each of said cavities formed in said clamping plates is provided with a four-pole coil for focusing which is composed of four four-pole magnetic poles respectively formed in the four corners of the cavity and having a protruding portion with a hyperbolic vertical section and coils respectively wound around said four-pole magnetic poles.

5. An electromagnet as claimed in claim 1, further comprising a steering-magnet mounting means composed of at least a pair of pedestals for supporting and fixing the steering coils of said steering magnets and fitting sections formed at opposed positions in said cavities with said equilibrium orbit for charged particles therebetween.

6. An electromagnet as claimed in claim 5, wherein each of said pedestals has a top surface to which one of said steering coils is fixed, a bottom surface which is brought into contact with an edge section of each of said cavities, and side surfaces on both sides thereof which form keys together with said bottom surface and which are at an angle less than 90° with respect to said bottom surface, said fitting sections formed in said cavities including key seats adapted to be closely engaged with said keys.

7. An electromagnet as claimed in claim 2, wherein said electromagnet is a deflecting electromagnet.

8. An electromagnet as claimed in claim 2, wherein said electromagnet is a superconducting electromagnet.

9. An electromagnet as claimed in claim 2, wherein said return yokes are made of a material having a high permeability, and wherein said clamping plates are made of an iron material.

10. A deflecting electromagnet for a charged-particle apparatus, comprising a principal coil including at least one pair of banana-shaped coils each of which consists of an outer and an inner coil forming a banana-shaped loop extending along an equilibrium orbit for charged particles, the radius of curvature of the outer and inner coils of each of said banana-shaped coils being larger in their end sections than in their middle sections.

11. A deflecting electromagnet as claimed in claim 10, wherein said deflecting electromagnet is a superconducting electromagnet.

12. An electromagnet for a charged-particle apparatus, comprising:

a principal coil comprising at least one pair of coils extending along with an equilibrium orbit for charged particles and arranged with said equilibrium orbit therebetween; and an iron core consisting of return yokes which surround and extend along said principal coil and clamping plates provided at both ends of said return yokes, said return yokes having at least one of a thickness which is different at different positions along said equilibrium orbit and gaps provided at predetermined positions along said equilibrium orbit, and said clamping plates having cavities in their respective central sections through which said equilibrium orbit for charged particles runs;

the magnetic reluctance of said iron core being different at different positions along said equilibrium orbit.

13. An electromagnet as claimed in claim 12, wherein said electromagnet is a deflecting electromagnet, and wherein said principal coil consists of at least one pair of banana-shaped coils, wherein the thickness of said return yokes is smaller in their longitudinal end sections than in their middle sections, and wherein said gaps are provided at the ends of said return yokes.

14. An electromagnet as claimed in claim 12, further comprising at least one iron-core slit formed in part of said return yokes, at least one iron insertion plate to be inserted into said at least one iron-core slit, and fixing means for fixing said at least one insertion plate to said return yokes with said at least one insertion plate being inserted to a corresponding predetermined depth into said at least one iron-core slit.

15. An electromagnet as claimed in claim 14, wherein the thickness of said at least one insertion plate is varied in at least one of a direction parallel to said equilibrium orbit and a direction perpendicular to said equilibrium orbit.

16. An electromagnet as claimed in claim 12, wherein a plurality of iron adjusting plates whose thickness is varied in a direction perpendicular to said equilibrium orbit are incorporated into said gaps provided in said return yokes.

17. An electromagnet as claimed in claim 12, wherein said electromagnet is a deflecting electromagnet.

18. An electromagnet as claimed in claim 12, wherein said electromagnet is a superconducting electromagnet.

19. An electromagnet as claimed in claim 12, wherein said return yokes are made of a material having a high permeability, and wherein said clamping plates are made of an iron material.

* * * * *